United States Patent [19]

Blackmon et al.

[11] 4,414,801

[45] Nov. 15, 1983

[54] PROCESS FOR MAKING SPUN-LIKE YARN WITH VARIABLE DENIER FILAMENTS

[75] Inventors: Lawrence E. Blackmon, Foley, Ala.; John R. Dees; Wayne T. Mowe, both of Pensacola, Fla.

[73] Assignee: Fiber Industries, Inc., Charlotte, N.C.

[21] Appl. No.: 232,742

[22] Filed: Feb. 9, 1981

Related U.S. Application Data

[63] Continuation of Ser. No. 922,937, Jul. 10, 1978, abandoned.

[51] Int. Cl.[3] ..... D02G 1/02; D01D 5/20; D01D 5/30

[52] U.S. Cl. ..... 57/288; 57/2; 57/206; 57/208; 57/247; 264/167; 264/168; 264/177 F

[58] Field of Search ..... 57/2, 206, 208, 248, 57/284, 287, 288, 247; 28/243; 264/147, 167, 168, 210.4, 177 F

[56] References Cited

U.S. PATENT DOCUMENTS

| | | | |
|---|---|---|---|
| 2,278,888 | 4/1942 | Lewis | 28/243 X |
| 3,387,327 | 6/1968 | Privott, Jr. et al. | 425/462 X |
| 3,425,206 | 2/1969 | Holton | 57/208 |
| 3,497,585 | 2/1970 | Chapman et al. | 264/168 X |
| 3,857,232 | 12/1974 | Heinrich et al. | 57/2 |
| 3,857,233 | 12/1974 | Cardinal et al. | 57/284 |
| 3,958,406 | 5/1976 | Corbiere | 57/206 |
| 3,967,441 | 7/1976 | Yasuzuka et al. | 57/2 X |
| 4,026,098 | 5/1977 | Bosley | 57/208 X |
| 4,059,950 | 11/1977 | Negishi et al. | 57/288 X |
| 4,080,778 | 3/1978 | Adams et al. | 57/2 X |
| 4,086,751 | 5/1978 | Hino et al. | 57/288 |
| 4,110,965 | 9/1978 | Bradley et al. | 57/2 X |

FOREIGN PATENT DOCUMENTS

| | | | |
|---|---|---|---|
| 42-22339 | 9/1968 | Japan | 264/177 F |

*Primary Examiner*—John Petrakes

[57] ABSTRACT

A yarn having variable denier filaments with thick and thin regions is drawn at a draw ratio selected to break filaments in the thin regions. This may be done while false-twist texturing. The resulting broken ends protrude from the yarn, giving a spun-like yarn.

3 Claims, 6 Drawing Figures

PROCESS FOR MAKING SPUN-LIKE YARN WITH VARIABLE DENIER FILAMENTS

This is a continuation of application Ser. No. 922,937 filed July 10, 1978, now abandoned.

The invention relates to novel processes for making from a yarn consisting of essentially continuous filaments a yarn simulating one spun from staple fibers.

It is known to treat certain types of continuous filament yarns by various processes to produce yarns which simulate to some degree yarns spun from staple fibers. Typical prior art processes which break the filaments so as to leave the broken ends protruding from the yarn bundle are Heinrich U.S. Pat. No. 3,857,232; Cardinal U.S. Pat. No. 3,857,233; and Yasuzuka U.S. Pat. No. 3,967,441, the disclosures of which are incorporated herein by reference. Fairley British Specification No. 971,573 discloses a similar process wherein the broken filament ends are stated to be entangled within the yarn bundle, rather than protruding from the bundle. In each of these and other known processes wherein filaments are broken, the breakable filaments are substantially uniform from end to end. That is, there is made no provision for preferred locations of breakage along the breakable filaments, and hence, less control of breakage than might be desired.

According to the present invention, this and other difficulties in the prior art are avoided by using a feed yarn having preferred locations for breakage along the breakable filaments.

According to a first major aspect of the invention, there is provided a process for making a spun-like yarn comprising drawing a feed yarn, the feed yarn comprising a plurality of continuous filaments, each of this plurality of filaments having a cross-sectional area which varies repetitively from small values in thin regions to large values in thick regions along its length, the large values being at least 25% greater than the small values, the thick and thin regions being out of phase from filament to filament along the length of the yarn, the filaments being repeatedly broken to provide broken ends primarily in the thin regions, the broken ends protruding from the bundle.

According to another aspect of the invention, the yarn is false-twisted while being drawn.

According to another aspect of the invention, the yarn is false-twisted and heat-set while being drawn.

According to another aspect of the invention, the average distance between consecutive thick portions along each of the filaments is between 2 centimeters and 20 meters, and preferably between 20 centimeters and 5 meters.

According to another aspect of the invention, the large area values are at least 100% greater than the small area values, and preferably are between 300% and 500% of the small area values.

Other aspects of the invention are in part set forth below and will in part be obvious from the following description taken in connection with the accompanying DRAWINGS wherein.

PREPARATION OF EXAMPLARY FEED YARN

The feed yarn for the process invention will be specifically exemplified using polyester polymer, it being understood that certain aspects of the invention are applicable to the class of melt-spinnable polymers generally. "Polyester" as used herein means fiber-forming polymers at least 85% by weight of which is formable by reacting a dihydric alcohol with terephthalic acid. Polyester typically is formed either by direct esterification of ethylene glycol with terephthalic acid, or by ester interchange between ethylene glycol and dimethylterephthalate.

Figure 1:
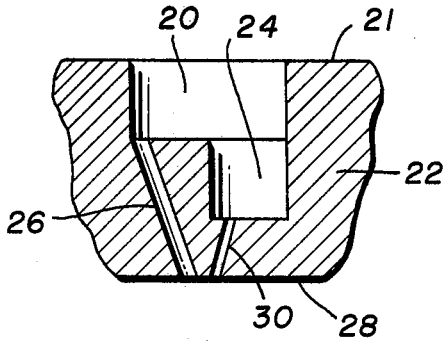
FIG. 1 is a vertical sectional view of the preferred embodiment of a spinneret usable to make the feed yarns according to the invention.
Figure 2:
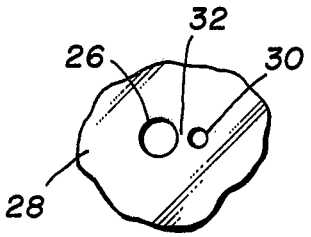
FIG. 2 is a bottom plan view of the FIG. 1 spinneret, looking up.
Figure 3:
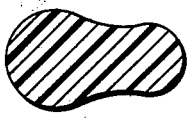
FIG. 3 is a cross-sectional view of a filament according to certain aspects of the invention.

FIGS. 1 and 2 illustrate the preferred embodiment of a spinneret design which can be employed for obtaining all aspects of the invention. The spinneret includes a large counterbore 20 formed in the upper surface 21 of spinneret plate 22. Small counterbore 24 is formed in the bottom of and at one side of large counterbore 20. A large capillary 26 extends from the bottom of large counterbore 20 at the side opposite small counterbore 24, and connects the bottom of large counterbore 20 with the lower surface 28 of plate 22. Small capillary 30 connects the bottom of counterbore 24 with surface 28. Capillaries 26 and 30 are each inclined four degrees from the vertical, and thus have an included angle of eight degrees. Counterbore 20 has a diameter of 0.113 inch (2.87 mm.), while counterbore 24 has a diameter of 0.052 inch (1.32 mm.). Capillary 26 has a diameter of 0.016 inch (0.396 mm.) and a length of 0.146 inch (3.81 mm.), while capillary 30 has a diameter of 0.009 inch (0.229 mm.) and a length of 0.032 inch (0.813 mm.). Land 32 separates capillaries 26 and 30 as they emerge at surface 28, and has a width of 0.0043 inch (0.108 mm.). Plate 22 has a thickness of 0.554 inch (14.07 mm.). Capillaries 26 and 30 together with counterbore 20 and 24 constitute a combined orifice for spinning various novel and useful filaments according to the invention, as will be more particularly described hereinafter.

As a specific example, molten polyester polymer of normal textile molecular weight is metered at a temperature of 290° C. through a spinneret having 34 combined orifices as above specifically disclosed. The polymer throughput is adjusted to produce filaments of 8 average denier per filament at a spinning speed of 3400 yards per minute, the molten streams being conventionally quenched into filaments by transversely directed quenching air.

Figure 4:
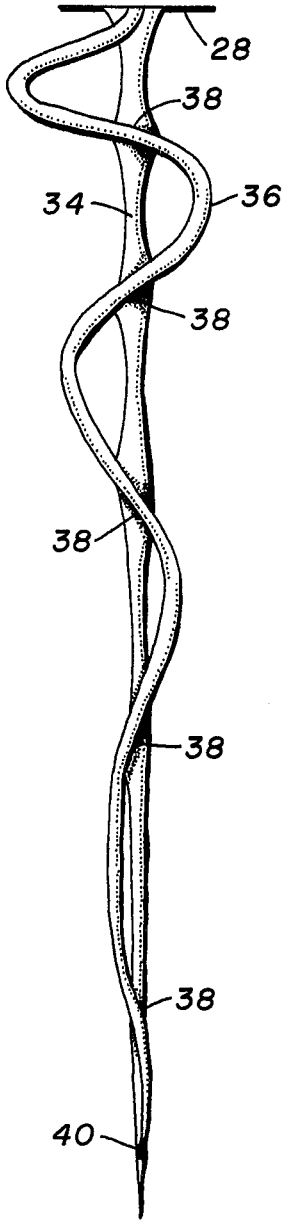
FIG. 4 is a side elevation view of the molten streams issuing from the FIG. 1 spinneret according to certain aspects of the invention.

Under these spinning conditions a remarkable phenomenon occurs, as illustrated in FIG. 4. Due to the geometry of the spinneret construction, the polymer flowing through the smaller capillaries 30 has a higher velocity than that flowing through the larger capillaries. The speeds and momenta of the paired streams issuing from each combined orifice and the angle at which the streams converge outside the spinneret are such that the slower streams 34 travel in substantially straight lines after the points at which the paired streams first touch and attach, while each of the smaller and faster of the streams 36 forms sinuous loops back and forth between successive points of attachment 38 with its associated larger streams. This action can be readily observed using a stroboscopic light directed onto the streams immediately below the spinneret face 28. As the molten streams accelerate away from the spinneret, the slower stream attenuates between the points of attachment 38 and the loops of the faster stream become straightened until the faster stream is brought into continuous contact with the slower stream. The slower stream attenuates more between the points of first attachment than at the points of first attachment so that the resulting combined stream has a cross-section which is larger at the points of first attachment than in the regions between these points. The resulting combined stream is then further attenuated somewhat until it is solidified into a filament 40 by the transverse quench air.

Figure 5:
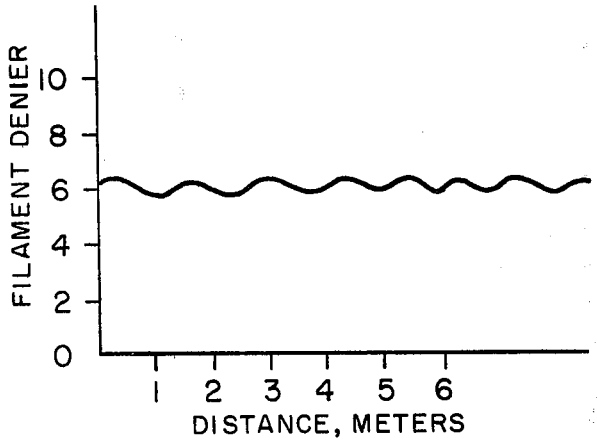
FIG. 5 is a graph illustrating the variation in denier along a representative filament according to certain aspects of the invention.

Each solidified filament 40 has non-round cross-sectional areas which vary repetitively along its length. As illustrated qualitatively in FIG. 5, when using the above spinning conditions, the filament cross-sectional area repetitively varies at a repetition rate of about one per meter, although this can be varied by modifying the spinning conditions and the geometry of the spinneret passages.

Figure 6:
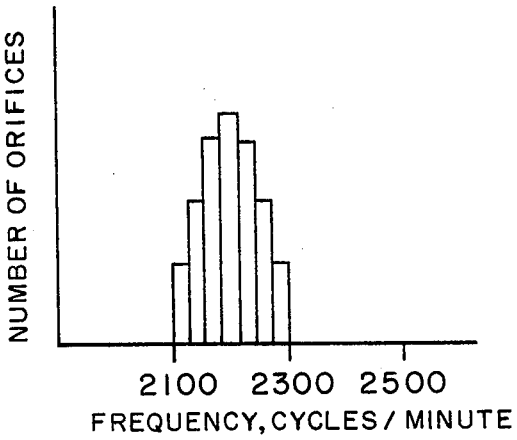
FIG. 6 is a graph illustrating the distribution of the fluctuations illustrated in FIG. 4 for a representative multiple orifice spinneret according to certain aspects of the invention.

Due to minor differences between combined orifices, temperature gradations across the spinneret, and other like deviations from exactly the same treatment for each pair of streams, a multiple orifice spinneret will typically provide somewhat different repetition rates among the several resulting streams and filaments. An example of this is qualitatively shown in FIG. 6, wherein is shown that various orifices produce somewhat different repetition rates as determined by stroboscopic examination of the combined streams just below the spinneret face. In the resulting multifilament yarn, each filament has a cross-sectional area which varies repetitively from small values in thin regions to large values in thick regions along its length, the large values being at least 25% greater than the small values. Improved spun-like effects in the ultimate textured yarn are obtained when the large values are at least 100% greater than the small values, with optimum results when the large values are between 300% and 500% of the small values.

AN EXEMPLARY PROCESS OF THE INVENTION

The above feed yarn is simultaneously draw-textured on a Barmag FK-4 texuring machine, using as the false-twist device a friction aggregate of the type disclosed in Yu U.S. Pat. No. 3,973,383, the disclosure of which is incorporated herein by reference. The drawn ratio is set at 1.60 with a winding speed of 385 ypm (about 350 meters per minute). Both heaters are set at 200° C., with an overfeed to the second heater of 10.47% and an overfeed to the winder of 6.79%,. The aggregate speed is set such that the yarn tensions just before and just after the aggregate are equal.

The resulting yarn has numerous filament breaks primarily in the thin regions, the broken ends protruding from the yarn bundle. The filaments are broken with considerably more control than those in the patents referred to above, and, because of the variable denier, fabrics made from the resulting yarns have a much more soft and luxurious hand than those made from prior art yarns with the same average denier per filament. This softness of hand is particularly evident when the cross-sectional areas of the thick portions of the filaments are at least 100% greater than those of the thin portions, and values between 300% and 500% greater are particularly preferred.

We claim:

1. A process for making a spun-like yarn comprising:

(a) providing a feed yarn comprising a plurality of continuous polyester filaments, each of said filaments having been prepared by the steps comprising;

(1) metering polyester polymer through a combined orifice to form molten polyester streams traveling in different extrusion speeds;

(2) converging and attenuating said molten polymer streams to form a combined stream having thick and thin regions repetitively along its length; and (3) quenching said combined stream into a filament and withdrawing said plurality of filaments thereby forming said feed yarn;

whereby each of said plurality of polyester filaments has a cross sectional area which varies repetitively from small values in thin regions to large values in thick regions along its length, said large values being at least 25% greater than said small values, said thick and thin regions being out of phase from filament to filament along length of said yarn;

(b) drawing while heating and false twisting said polyester feed yarn, said drawing being at a draw ratio selected to break a plurality of said filaments primarily in said thin regions.

2. The process defined in claim 1, wherein said large values are at least 100% greater than said small values.

3. The process defined in claim 1, wherein said large values are between 300% and 500% of said small values.

* * * * *